US005102726A

United States Patent [19]

Gabbay

[11] Patent Number: 5,102,726

[45] Date of Patent: Apr. 7, 1992

[54] FLEXIBLE COMPOSITE LAMINATE COMPRISING A TEXTILE SUBSTRATE, CEMENTITIOUS LAYER AND SEALING LAYER

[76] Inventor: Jeffrey S. S. Gabbay, Apt. 21, 14 Jabotinsky Street, Jerusalem, Israel

[21] Appl. No.: 504,557

[22] Filed: Apr. 3, 1990

[51] Int. Cl.[5] ..... B32B 7/00; B32B 13/00; D03D 3/00; B27N 9/00

[52] U.S. Cl. ..... 428/251; 428/246; 428/268; 428/282; 428/285; 428/703; 428/921

[58] Field of Search ..... 428/246, 249, 266, 283, 428/703, 251, 268, 282, 285, 921; 521/106, 121

[56] References Cited

U.S. PATENT DOCUMENTS

| | | | |
|---|---|---|---|
| 3,934,066 | 1/1976 | Murch | 428/249 |
| 4,042,536 | 8/1977 | Dieterich et al. | 521/122 |
| 4,572,862 | 2/1986 | Ellis | 428/245 |
| 4,661,398 | 4/1987 | Ellis | 428/246 |
| 4,714,650 | 12/1987 | Obayashi et al. | 428/266 |
| 4,743,624 | 5/1988 | Blount | 521/106 |

*Primary Examiner*—George F. Lesmes
*Assistant Examiner*—James D. Withers
*Attorney, Agent, or Firm*—Abelman Frayne and Schwab

[57] ABSTRACT

A flexible composite laminate, which is fire resistant on either one or both sides, comprises: (a) a textile web substrate; and the following combination of successive layers on either one or on both sides of the substrate, namely: (b) a first discrete adhesive layer, to provide adhesive bonding between substrate (a) and a layer (c); (c) a layer superimposed upon the first discrete adhesive layer, which comprises at least one fire-resistance imparting inorganic substance in an amount effective to impart fire-resistance to a preselected degree to the substrate; (d) a second discrete adhesive layer on layer (c), to provide adhesive bonding between layer (c) and a sealing layer (e), as defined below; and (e) a hydrophobic sealing layer superimposed on the second discrete adhesive layer. The first adhesive layer may be optionally omitted when the substrate is a fiberglass substrate, and/or the second adhesive layer may be optionally avoided when the hydrophobic sealing layer is silicone-based. When layer (e) is e.g. PVC, it is found that the emission of smoke is reduced as compared with unlaminated PVC.

11 Claims, 1 Drawing Sheet

FLEXIBLE COMPOSITE LAMINATE COMPRISING A TEXTILE SUBSTRATE, CEMENTITIOUS LAYER AND SEALING LAYER

FIELD OF THE INVENTION

The present invention relates to a flexible composite laminate adapted to provide fire resistance on at least one side of a textile web substrate.

BACKGROUND OF THE INVENTION

Current textile technology uses a number of approaches to impart fire resistance or flame retarding ability to fibers and fabrics. In one method, flame retardant chemical finishes are applied directly to the substrate; suitable chemicals include illustratively tris(2,3-dibromopropyl) phosphate, ammonia-cured tetrakis(hydroxymethyl)phosphonium hydroxide (THPOH), tetrakis(hydroxymethyl)phosphonium chloride (THPC), decabromodiphenyloxide (DBDPO), and various halogen/phosphorus, nitrogen/phosphorus, boron/phosphorus and antimony compounds and certain inorganic salts. In another method, chemicals are added directly to fiber spinning solutions to obtain flame retardant fibers, exemplary trade names of which are "Acrylon Plus", and "Zefron FR" acrylic fibers and "Trevira" polyesters. In yet another method, fibers are produced which are intrinsically flame retardant; examples are aramids such as "Nomex" and "Kevlar", modacrylics such as "Verel", "SEF" and "Orlon FR" and polybenzimidazole (PBI).

U.S. Pat. No. 4,572,862 (Ellis) discloses inter alia a composition suitable for use as a fire barrier when cured, which comprises a flowable, substantially uniform dispersion of (A) a binder component comprising a powdered, substantially uniform mixture of (1) heat activated MgO, and (2) high alumina calcium aluminate cement comprising 70% to 80% $Al_2O_3$; in (B) a gauging component in about a stoichiometric amount sufficient to react with the binder component, and comprising an aqueous solution of $MgCl_2$ or $MgSO_4$, wherein the aqueous solution has a specific gravity of about 26° to about 32° Baume. The entire disclosure of U.S. Pat. No. 4,572,862 is incorporated herein by reference.

The composition described in the foregoing paragraph may, as described in the Ellis Patent, be coated on a solid substrate, and the latter may be adhered to a rigid support so as to constitute a fire barrier. The substrate may be, by way of example, a non-woven spunbonded polyester fabric or a woven or non-woven fiberglass fabric. The composition of the Ellis Patent is generally described therein as a paint, and the principal applications of the composition lie in the building industry; thus, for example, it is mentioned that multilayers may be built up from paint impregnated non-woven spunbound polyester geotextile fabric, so as to form structural laminates. The purpose of the fabrics utilized in this Patent appear to be to provide stress-relief foci and to form a basis or perhaps a reinforcement for structural purposes.

"Pyrotite" is the trade name of product marketed by the Pyrotite Corporation of Miami, Fla., which utilizes the fire-barrier composition disclosed in the Ellis Patent. Certain forms of "Pyrotite" may contain various proportions of latex, in order to impart different degrees of flexibility to the ultimate cured product.

In the Ellis Patent, textile fabrics are used to make structural laminates, but there is no teaching therein that fabrics when coated with the fire-barrier producing composition can be used for the applications for which fabrics are more generally used, such as textiles which need to be subjected to folding or even to a certain amount of crushing, and to which additionally, it is desired to impart fire-retardant properties.

Consistent with the restricted teaching in the Ellis Patent in relation to the employment of fabrics for making e.g. structural laminates, the present inventor has found that, for example, "Pyrotite" compositions, even when containing added latex, do not possess adequate adhesion and flexibility to make their use viable for textile applications. By contrast, the inventor has found that such compositions can be applied to textiles by making a composite laminate employing layers of adhesive and a sealing layer, in addition to an inorganic-based fire-retardant layer. This is to be regarded as a surprising result, since to the inventor's knowledge this kind of lamination has not been used hitherto in order to impart fire-retardancy to textiles, in which the product is flexible in that it is foldable and crushable, at least to some degree, without delamination.

SUMMARY OF THE INVENTION

It is an object of the present invention to provide a flexible composite laminate incorporating a fire susceptible textile web substrate, whereby the substrate is protected by a flame and heat barrier which inter alia prevents or retards ignition, flame spread and flame penetration. Another object of the invention is the reduction of smoke emission when a material such as PVC is exposed to a fire. Other objects of the invention will be apparent as the description proceeds.

The present invention accordingly presents a flexible composite laminate, adapted to provide fire resistance on at least one side thereof, which comprises: (a) a textile web substrate; and the following combination of successive layers on at least one side of said substrate, namely: (b) a first discrete adhesive layer, adapted to provide adhesive bonding between substrate (a) and a layer (c), as defined below; (c) a layer superimposed upon the first discrete adhesive layer, which comprises at least one fire-resistance imparting inorganic substance in an amount effective to impart fire-resistance to a preselected degree to the substrate; (d) a second discrete adhesive layer on layer (c), adapted to provide adhesive bonding between layer (c) and a sealing layer (e), as defined below; and (e) a hydrophobic sealing layer superimposed on the second discrete adhesive layer.

Although from one point of view the invention has the advantage of protecting the substrate by providing fire protection, yet from another aspect it has been surprisingly found that when sealing layer (e) of the composite of the invention is made from a material such as PVC which normally emits smoke when subject to a fire, the use of such material in layer (e) leads to a reduction of the smoke enission therefrom.

The preselected degree of fire-resistance and flexibility desired to be imparted by layer or layers (c) will of course influence the composition and thickness of such layer(s). Persons skilled in the art will have the ability to adjust this degree of fire-resistance and flexibility for a particular application. Without prejudice to the broad scope of the invention, however, it will generally be desired that the laminate of the invention will have a temperature less than 100° C. after exposure to the blue part of a bunsen burner flame for two minutes.

It will be appreciated that the invention includes a composite laminate in which the combination of layers (b), (c), (d) and (e) is on one side only of the textile web substrate (a), as well as the embodiment in which the combination of layers (b), (c), (d) and (e) is on each side of the textile web substrate (a). When the combination of layers is on one side only of the substrate, the reverse side of the substrate may be coated with a hydrophobic sealing layer, which may be the same as or different from layer (e); the reverse side may, if desired, be first coated with a layer of adhesive prior to coating with a sealing layer. The choice of material for layer (e), as well as for the optional hydrophobic layer on the reverse side, in the embodiment when only one side of the substrate is laminated, will obviously depend on the particular application of the end-product; thus, e.g. in an environment expected to be subject to the action of liquid hydrocarbons, polyurethanes may be preferred over polyvinyl chloride.

It is moreover within the contemplation and scope of the present invention to optionally avoid the use of the first adhesive layer when the substrate is a fiberglass substrate and/or to optionally avoid the use of the second adhesive layer when the hydrophobic sealing layer is silicone-based. It is believed to be within the ordinary non-inventive ability of persons skilled in the art to determine when it is both possible and desirable to avoid the use of either or both of the first and second adhesive layers. It will also be apparent to skilled persons that the fire-resistant laminates, when present on each side of the substrate, may be the same as, or different from, each other.

DETAILED DESCRIPTION OF THE INVENTION

Figure 1:
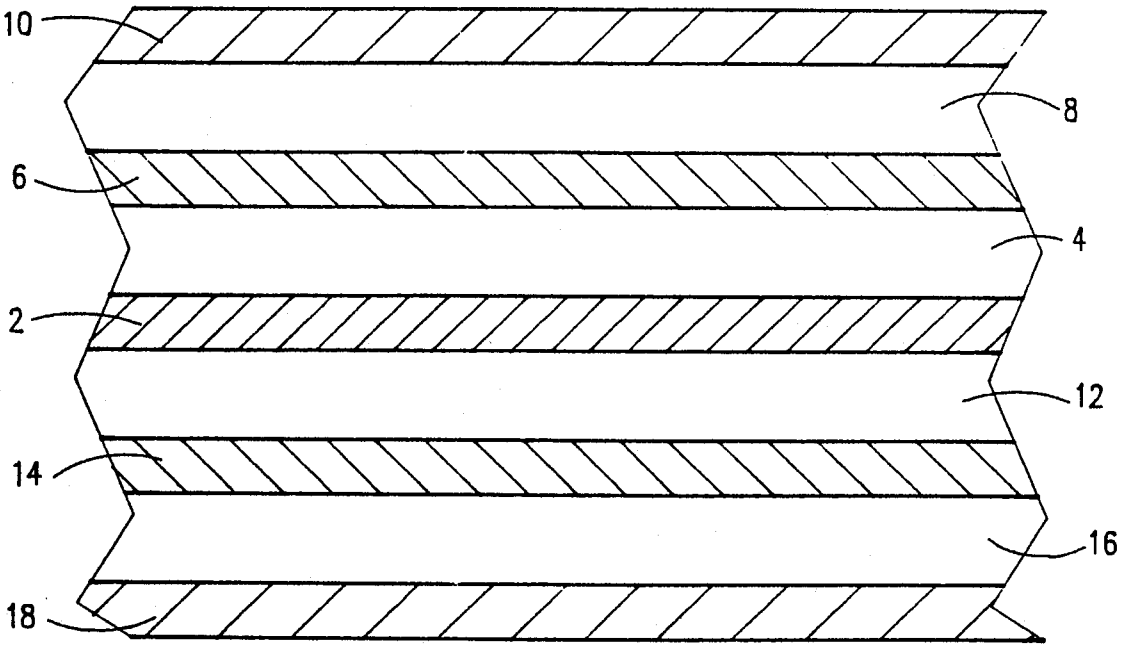
FIG. 1 illustrates an embodiment of the present invention.

By way of example, the textile web fabric substrate (a) may be composed of one or a combination of woven or non-woven polyesters, polyethylenes, cottons, nylons, aramids, core-yarns and fiberglass. The textile will naturally be selected for its properties (such as tensile strength, impact strength, tear resistance and elongation), in relation to a particular application.

The fire-resistance imparting inorganic substance in layer (c) may comprise, for example, one or more of the following, namely, Portland cement, gypsum, calcium aluminate cement, phosphate-bonded cement, metal-pigment loaded silicates, high temperature silicones, expanded vermiculite, antimony oxide, alumina trihydrate, magnesia, magnesium oxychloride and magnesium oxysulfate. Calcium aluminate cement is preferably high alumina calcium aluminate cement. For the purpose of layer (c), the commercially available product "Pyrotite" (mentioned above), may be used, but of course the invention is not restricted thereto. "Pyrotite" is normally an intense white material, which can however be tinted by the inclusion of appropriate colorants. Layer (c) is a relatively thin layer; thus it is unlikely that the thickness of layer (c) (or the total thickness of both layers (c), if two such layers are present) will ever be greater than 0.5 mm., for most applications.

The hydrophobic sealing layer (e) may e.g. comprise at least one of the following, namely, silicones, polyurethanes, polytetrafluoroethylene, polyvinyl chloride, polyvinyl fluoride and hydrophobic copolymers of polytetrafluoroethylene, polyvinyl chloride and polyvinyl fluoride with other comonomers. As previously mentioned, choice of material for layer (e) will depend on the particular application of the end-product, e.g. in an environment subject to the action of liquid hydrocarbons, polyurethanes may be preferred over polyvinyl chloride.

In accordance with the invention, it is preferred, though not essential, that the hydrophobic sealing layer (e) comprises at least one fire-resistance imparting inorganic substance, such as, by way of example, at least one of Portland cement, gypsum, calcium aluminate cement, phosphate-bonded cement, metal-pigment loaded silicates, high temperature silicones, expanded vermiculite, antimony oxide, alumina trihydrate, magnesia, magnesium oxychloride and magnesium oxysulfate. The inorganic substance in layer (e) is preferably finely-divided, having e.g. a particle size in the range of from about 1-2 microns and up to about 100 microns; a particle size no more than about 50-60 microns is preferred, and a particle size of the order of about 10 microns is particularly preferred. Ground cured "Pyrotite" may also be used as fire-resistance imparting ingredient of layer (e). It is especially preferred that, in the event layer (e) comprises at least one fire-resistance imparting inorganic substance, that this substance be preselected for its smoke suppressive properties. A non-limiting example of this especially preferred embodiment is the use of alumina trihydrate.

The first and secnd adhesive layers may be the same as, or different from, each other. By way of example, the adhesive layers may be of the cyanoacrylic, acrylic or silicone types.

An embodiment of the present invention in which both sides of the textile web substrate are laminated as taught herein, is illustrated schematically in FIG. 1. It will be appreciated that this illustration is not drawn to scale. For certain applications it may only be necessary to build up the laminate in accordance with the invention on one side only of the textile web substrate. In the illustrated embodiment, textile substrate 2 is coated on both sides with first adhesive layers 4 and 12, then superimposed on these are fire-barrier material layers 6 and 14, respectively, superimposed on the latter are second adhesive layers 8 and 16, respectively, and finally superimposed on the second adhesive layers are sealing layers 10 and 18, respectively. It will be appreciated that corresponding layers on opposite sides of the substrate need not be identical, one with the other.

The various layers may be applied using any practical method known to persons skilled in the art, a number of which are mentioned in the Ellis Patent.

The present invention will be illustrated by the following non-limitative Example.

EXAMPLE

A flexible composite laminate for use as a fire-barrier tarpaulin was made using as substrate a polyester scrim (approximately 0.5 mm. in thickness). This was initially coated on both sides with an acrylic adhesive, Robond PS-83 (Rohm and Haas), and the double coating was oven-dried for one minute at 80° C. A 0.2 mm. thick coating of "Pyrotite" (fast-drying "Type 2" formulation containing 20% latex) was added to one side, oven-dried at 80° C. for 3 minutes, then an identical coating of "Pyrotite" was applied to the other side and dried in the same manner. Each of the dried "Pyrotite" coatings was then coated with the same adhesive as before, and the thus-formed intermediate laminate was dried at ambient temperature for 0.5 hour. A coating of polyvinyl chloride (approximately 0.7 mm. thickness) was applied to one side of the thus-obtained dried intermediate laminate and cured for one minute at 180° C., and a similar coating was applied to the other side and cured under identical conditions. While any methods known in the art may be used for applying the various layers, in this particular illustrative Example, the adhesive was applied by brushing and the other layers by knife coating. Also, while in this Example the application of the various layers is applied to both sides in parallel, it is equally possible within the contemplation of the present invention, where it is ultimately desired to apply the layers to both sides of the substrate, to achieve this end by completing application of the layers to one side of the substrate, before proceeding to application of the layers to the reverse side of the substrate. This embodiment may be preferable for large scale production runs of the flexible composite laminate of the invention.

The composite laminate thus produced was tested by suspending it horizontally on a circular iron frame, and depressing the center to form a pocket capable of holding a liquid without spilling. One-third of a cup of kerosene was placed in the depression and ignited. The fire burned for 2 minutes 25 seconds, until the kerosene was consumed. The upper sealing (PVC) layer was completely charred while the lower sealing layer showed no signs of charring, cracking, pocking, delaminatio, or any other manifestation of heat transmission and/or flame penetration. Substantially all of the polyester substrate remained intact. During the combustion process, a hand was placed on the bottom of the laminate and held there for about one minute without registering any appreciable increase in temperature. When a fiberglass substrate was used instead of polyester, substantially similar results were obtained, even without the initial adhesive coating.

Comparative experiments using a polyester substrate with PVC sealed (0.1–0.2 mm. thick) "Pyrotite" coatings on each side of the substrate, but without use of adhesive were unsuccessful, because adhesion of the "Pyrotite" layers to the substrate was insufficient to withstand flexural stress. Coating of cotton substrates without the use of an adhesive binder was similarly unsuccessful; it was found that the cotton absorbed the liquid portion of the "Pyrotite" without retaining the cementitious inorganic materials and therefore was unable to provide consistent fire/flame protection. As already mentioned, it was surprisingly found that in such composite laminates of the invention, using materials such as PVC for the outer sealing layer, the emission of smoke is reduced as compared with unlaminated PVC.

APPLICATIONS OF THE INVENTION

It is presently contemplated that the present invention, the product of which is a flexible and durable laminate, will be applicable to heavy duty tarpaulins, dry storage systems, collapsible fuel containers, firemens' apparel, upholstery fabrics, portable fire barriers, thermal insulators for use in the protection of any objection that could be harmed by exposure to excessive heat, portable protection against flying sparks, or any other application where protection from heat or fire is required. The invention is of course not restricted to these specified applications.

While the present invention has been particularly described with regard to preferred embodiments thereof, it will be apparent to persons skilled in the art that it will not be restricted to such embodiments, but that many variations and modifications may be made. Accordingly, the concept, spirit and scope of the present invention are rather to be understood in relation to the claims which follow.

I claim:

1. A non-ignitable, flexible and foldable composite laminate, which consists of:

(a) a textile web substrate; and the following combination of successive layers on at least one side of said substrate, namely:

(b) a first discrete adhesive layer adapted to provide adhesive bonding between substrate (a) and a layer (c), as defined below;

(c) a cementitious layer superimposed upon said first discrete adhesive layer, in an amount effective to impart fire-resistance to said substrate;

(d) a second discrete adhesive layer adapted to provide adhesive bonding between said layer (c) and a sealing layer (e), as defined below; and (e) a hydrophobic sealing layer superimposed on said second discrete adhesive layer, and wherein said hydrophobic sealing layer (e) comprises at least one non-cementitious fire-resistance imparting inorganic substance.

2. A laminate according to claim 1, wherein said hydrophobic sealing layer (e) comprises at least one fire-resistance imparting inorganic substance selected from the group consisting of, metal-pigment loaded silicates, expanded vermiculite, alumina trihydrate, magnesia, magnesium oxychloride and magnesium oxysulfate.

3. A laminate according to claim 1, wherein said combination is on one side only of said textile web substrate (a).

4. A laminate according to claim 2, wherein the other side of said substrate is coated with a hydrophobic sealing layer.

5. A laminate according to claim 1, wherein said combination is on each side of said textile web substrate (a).

6. A laminate according to claim 1, wherein said textile web fabric (a) comprises at least one member selected from the group consisting of woven and nonwoven polyesters, polyethylenes, cottons, nylons, aramids, and fiberglass.

7. A non-ignitable, flexible and foldable composite laminate which consists of:

a fiberglass textile web substrate and the following combination of successive layers on at least one side of said substrate, namely: a cementitious layer superimposed upon said substrate, in an amount effective to impart fire-resistance to a preselected degree thereto; a discrete adhesive layer, adapted to provide adhesive bonding between said superimposed layer and a sealing layer as defined below; and a hydrophobic sealing layer on said adhesive layer, wherein said hydrophobic sealing layer comprises at least one fire-resistance imparting inorganic substance.

8. A laminate according to claim 7, wherein said hydrophobic sealing layer (e) comprises at least one fire-resistance imparting inorganic substance selected from the group consisting of, metal-pigment loaded silicates, expanded vermiculite, alumina trihydrate, magnesia, magnesium oxychloride and magnesium oxysulfate.

9. A laminate according to claim 7, wherein said combination is on one side only of said fiberglass textile web substrate.

10. A laminate according to claim 9, wherein the other side of said substrate is coated with a hydrophobic sealing layer.

11. A laminate according to claim 7, wherein said combination is on each side of said fiberglass textile web substrate.

* * * * *